United States Patent [19]

Cheng et al.

[11] 4,164,472

[45] Aug. 14, 1979

[54] $CACO_3$-CONTAINING DISPERSIONS

[75] Inventors: William J. Cheng; David B. Guthrie, both of St. Louis, Mo.

[73] Assignee: Petrolite Corporation, St. Louis, Mo.

[21] Appl. No.: 894,979

[22] Filed: Apr. 10, 1978

[51] Int. Cl.[2] ..... C10M 3/18; C10M 5/14; C10M 7/20; C10M 7/24

[52] U.S. Cl. ..... 252/18; 44/51; 44/DIG. 3; 252/25; 252/33; 252/39; 252/389 R

[58] Field of Search ..... 252/25, 18, 33, 39, 252/389 R; 44/51, DIG. 3

[56] References Cited

U.S. PATENT DOCUMENTS

| | | | |
|---|---|---|---|
| 2,641,531 | 6/1953 | Austin et al. | 423/636 |
| 2,641,532 | 6/1953 | Hicks | 423/636 |
| 3,055,829 | 9/1962 | Wiley et al. | 252/18 |
| 3,676,079 | 7/1972 | Morgan | 423/636 |
| 3,689,218 | 9/1972 | Hodges | 423/636 |
| 4,065,396 | 12/1977 | Dickey et al. | 252/33 |

OTHER PUBLICATIONS

Kirk-Othmer, Encyclopedia of Chem. Technology, vol. 4, p. 6, 1964.

*Primary Examiner*—Delbert E. Gantz
*Assistant Examiner*—Irving Vaughn
*Attorney, Agent, or Firm*—Sidney B. Ring; Hyman F. Glass

[57] ABSTRACT

This invention relates to stable, fluid $CaCO_3$-containing dispersions, and the preparations thereof by the high temperature decomposition of a Ca carboxylate such as Ca acetate, etc., in a dispersant-containing fluid.

17 Claims, No Drawings

$CACO_3$-CONTAINING DISPERSIONS

The patents listed are of interest to the present invention only to the extent to show that many patents have sought to claim unique methods for preparing oil-dispersible, basic calcium-containing compositions. However, none of these patents exhibit the astonishing uniqueness of the product obtained by the process of this invention.

| U.S. Patents | FR. Patents | British Patents | Other Foreign Patents | |
|---|---|---|---|---|
| 3,105,049 | 1,353,553 | 931,966 | Belg. | 629,945 |
| 3,125,521 | 1,356,762 | 941,441 | East German | 26,004 |
| 3,126,340 | 1,376,616 | | West German | 1,162,832 |
| 3,131,148 | 1,377,381 | | | |
| 3,133,019 | | | | |
| 3,155,616–7 | | | | |
| 3,170,880 | | | | |

In Ser. No. 840,192 filed Oct. 7, 1977, we described and claimed the preparation of stable, fluid magnesium oxide containing dispersions, and the preparation thereof, by the high temperature decomposition of magnesium acetate to magnesium oxide in a dispersant-containing fluid. In Ser. No. 853,600 filed Nov. 21, 1977, we described and claimed a process where substantially less than stoichiometric amounts of acetate to basic magnesium are employed in the preparation of stable fluid magnesium oxide containing dispersions.

When we run an analogous process with calcium acetate, instead of magnesium acetate, in a dispersant-containing fluid, analogous products are not obtained. For example, when calcium acetate is decomposed in a dispersant-containing fluid, we find that the product of decomposition is a dispersion of calcium carbonate rather than calcium oxide.

In U.S. Pat. No. 3,055,829 there is described and claimed a process for the decomposition of mixtures of the acetates of "alkali metals, alkaline earth metals, magnesium, zinc, cadmum, tin, lead and manganese" with an excess of corresponding basic reacting metal compound to yield the corresponding metal carbonates.

However, contrary to U.S. Pat. No. 3,055,829, we have discovered that not all of the above-mentioned metal acetates cited in U.S. Pat. No. 3,055,829 decompose to the metal carbonates. For example, we have specifically shown in Ser. No. 840,192 filed on Oct. 7, 1977, and in Ser. No. 853,600 filed Nov. 21, 1977, that magnesium acetate decomposes to yield the magnesium oxide, not magnesium carbonate.

In the practice of our invention there are other significant differences from that of U.S. Pat. No. 3,055,829:

(a) In decomposing calcium acetate to calcium carbonate in a dispersant-containing fluid, we have found that in order to achieve a superior highly overbased calcium-containing material, it is necessary to use stoichiometric amounts of acetate in relation to basic calcium. This requirement of our invention is contrary to the teachings of U.S. Pat. No. 3,055,829 which claims that an overbased calcium-containing material is formed only by employing substantially less than stoichiometric amounts of carboxylate in relation to the basic calcium compound employed. (b) In decomposing calcium acetate in the process of our invention, the decomposition to calcium carbonate is virtually quantitative such that no clarification is required for the resulting product by our invention. This is in contrast to the clarification that is required in the process by U.S. Pat. No. 3,055,829. (c) As a result of decomposing stoichiometric acetate in relation to basic calcium, the product obtained by our process has more than 2½ times the overbasing value found in the product of U.S. Pat. No. 3,055,829.

Therefore, the product of our invention has superiority over the product of U.S. Pat. No. 3,055,829 in two important aspects: (1) A much higher overbased product is achieved, for example, a 1000% overbased calcium-containing product in contrast to only 355% overbased product of U.S. Pat. No. 3,055,829. (2) The highly overbased product, as specified in (1), is achieved readily without the necessity to separate undispersed particles such as by filtration, centrifugation, etc., as is required by U.S. Pat. No. 3,055,829 for removing undispersed solids amounting to about 11% of the basic calcium material charged Although, we do not wish to be bound by actual theory, we believe that the formation of dispersible calcium carbonate results from the in situ formation of a highly porous and submicron sized calcium carbonate formed by the instant decomposition of the calcium carboxylate into a very volatile decomposition product and into residual highly porous calcium carbonate which is instantly dispersed by the dispersant-containing fluid. When the calcium carboxylate is calcium acetate, the decomposition which takes place in the dispersant-containing fluid is believed to proceed according to the following equation:

$$Ca(OCOCH_3)_2 \rightarrow CaCO_3 + CH_3COCH_3$$

Any suitable calcium carboxylate capable of being subdivided upon decomposition into submicron particles of calcium carbonate in a dispersant-containing fluid can be employed. Calcium acetate is the preferred starting molecule.

The carboxylic acids suitable for use in preparing stoichiometric amounts of calcium carboxylate in the process of this invention include aliphatic carboxylic acids, for example, formic, acetic, propionic, acrylic, butyric. Carboxylic acids containing other functional groups are useful. These include, for example, hydroxy carboxylic acids such as lactic. This group also includes ketocarboxylic acids such as pyruvic, acetoacetic. Dicarboxylic acids are also used; examples of such acids are malonic, maleic, succinic. The aromatic and substituted aromatic carboxylic acids are in a like manner useful materials for this invention. Some examples are benzoic, salicylic.

Any suitable non-volatile process fluid capable of being heated to the decomposition temperature of the calcium carboxylate can be employed. The process fluid should be relatively stable and relatively non-volatile during this decomposition. However, any volatility encountered is readily controlled by refluxing and condensing apparatus.

Examples of such non-volatile process fluids are as follows: hydrocarbons (such as mineral oil, paraffin oil, or aromatic oil), diphenyl oxide fluids, silicone oils, polyglycol ethers or vegetable oils, etc., solely the dispersant, or any combination thereof.

The non-volatile process fluid should contain a dispersant(s) capable of retaining the calcium carbonate compound formed by decomposition in stable suspension. Any suitable dispersant which is relatively stable under the decomposition conditions of this invention can be employed.

The concentration of the dispersant in the non-volatile process fluid should be sufficient to maintain a fluid, stable dispersion of in situ formed calcium carbonate in the fluid. In general, the weight concentrations of dispersant and non-volatile fluid may range from 100% dispersant and 0% non-volatile fluid to as little as 0.01% dispersant and 99.99% fluid, such as from about 1% and 99%, for example from about 2% and 98%, but preferably at least 3% and 97% dispersant and fluid, respectively.

Suitable dispersants are illustrated by the following: saturated and unsaturated fatty acids (such as stearic acid and oleic acid) and derivations thereof (such as sorbitan mono-oleate), sulfonic acids (such as mahogany or petroleum derived sulfonic acids and synthetic sulfonic acids), naphthenic acids, oxyalkylated fatty amines, alkylphenols, sulfurized alkylphenols, oxyalkylated alkylphenols, etc.

In this invention the preferable dispersing agent is an organic carboxylic acid or sulfonic acid or any mixture thereof which reacts with a calcium or magnesium compound to form a salt or other complex. The calcium or magnesium salt or complex of such acid moiety is formed by the reaction of an equivalent of basic calcium or magnesium moiety (such as, for example, calcium or magnesium oxide, calcium or magnesium hydroxide, calcium or magnesium carbonate, or any mixtures thereof) with a corresponding equivalent of acid moiety.

The reaction is carried out as follows. Since the decomposition temperature of Ca acetate is above 160° C., the reactant mixture is heated above this temperature. The decomposition products such as acetone are removed from the reaction by their volatility. In practice, temperatures of about 160° C. to 450° C. or higher are employed, such as from about 200° C. to 400° C., but preferably from about 250° C. to 400° C.

The particle size of the resulting $CaCO_3$ so formed in general should be of a size which is stable and fluid. In practice, the particle size is no greater than about 5 microns, such as no greater than about 2 microns, but preferably no greater than about one micron.

The concentration of the $CaCO_3$ so formed and dispersed in the non-volatile process fluid should be no greater than that concentration which maintains suitable fluidity. In general, the final concentration based on non-volatile fluid and other materials is from about 1% to 20% when calculated as percent calcium, such as from about 1.5% to 15%, but preferably from about 2% to 10%.

The following examples are presented for purposes of illustration and not of limitation.

EXAMPLE 1

To a reactor are charged 12.0 grams naphthenic acids at 365 equivalent weight, 250 grams hydrocarbon oil and 1.21 grams calcium hydroxide. The contents are stirred and heated to about 250° C. at which temperature the water of calcium naphthenate formation is removed. The reactor contents are then heated to 355° C. An aqueous solution of calcium acetate containing 28.9 grams calcium acetate monohydrate is added slowly while maintaining the reactor temperature at 355°–370° C. During the addition some of the hydrocarbon oil distills out but is returned as an upper layer from the water-oil separator. After all of the aqueous calcium acetate has been added, the reactor contents are heated to 385° C. at which temperature no more water is removed. The weight of the reaction product is 274.3 grams. The amount of insoluble matter is 0.05% as determined by centrifugation for 2 hours. The calcium analysis of the product 2.78% which calculates to a 1060% overbasing value.

EXAMPLE 2

Magnesium hydroxide (0.96 grams) is substituted for the calcium hydroxide of example 1 in order to form a magnesium naphthenate dispersant. The amount of a calcium alkalinity in the product is calculated at more than 1000% overbasing value.

The compositions of this invention have a wide variety of uses. The following are illustrative:

1. As a combination anti-corrosion and acidic neutralization additive for lubricating oils and greases.
2. As a combination anti-corrosion and acidic neutralization additive during the combustion of fuels such as residual fuel, pulverized sulfur-containing coal, or mixtures thereof.

USE AS ADDITIVES FOR AUTOMOTIVE AND INDUSTRIAL LUBRICANTS

A chemical additive in the usual sense refers to a material which enhances a desirable property while eliminating or minimizing one or more undesirable ones. Since about 1930 the commercial application of chemical additives to lubricating oils has kept pace with the increasing demands of modern machinery, such as automotive engines, high-speed machinery, high-pressure hydraulic control systems, etc. The literature and patent art are replete with examples of such additives which in general improve the lubrication performance for the machinery while minimizing the frequency of maintenance.

For combating the severe rust conditions which may be encountered during shipping of machinery or in long storage or exposure to out-door weather, sodium and calcium sulfonate additives are commonly used.

Additives for imparting detergency to lubricating oils are widely used at 2–20% concentration and are found to prevent or remove deposits of oil-insoluble sludge, varnish, carbon and lead compounds which otherwise form on internal combustion engine parts. The additives probably act by adsorbing and suspending the insoluble particles so that deposits are minimized, and cleanliness of rings, valves, and cylinder walls are maintained. Commercial detergent additive for such automotive and diesel engine oils are designed also to react chemically with the highly acidic by-products of combustion that find their way into the lubricating oil system. The additives with this type of functionality are usually comprised of basic barium, calcium, and magnesium salts of oil-soluble organic compounds.

A discussion of the preparation and use of overbased or hyperbasic detergent sulfonates is found in U.S. Pat. No. 3,057,896. The term "metal ratio," as used to describe the amount of overbasing or hyperbasic detergency in the additive, is defined as the ratio of equivalents of metal to equivalents of organic acid. The important metals which readily provide such overbasing are those of the alkaline earth group particularly magnesium, calcium, and barium.

The products of this invention at a metal ratio of about 11/1 such as the product described in Examples 1 and 2 can be employed as hyperbasic additives for lubricating oils.

We claim:

1. A process of preparing a stable, fluid calcium-containing dispersion in a non-volatile liquid and a dispersant which comprises heating a calcium carboxylate which contains stoichiometric amounts of carboxylate in relation to basic calcium at a temperature above the decomposition temperature of the said calcium carboxylate to obtain a virtually quantitative yield of $CaCO_3$ which is a highly overbased $CaCO_3$.

2. The process of claim 1 where the decomposition temperature is above about 160° C.

3. The process of claim 2 where the decomposition temperature is from about 200°–400° C.

4. The process of claim 1 where the calcium carboxylate is calcium acetate.

5. The process of claim 2 where the calcium carboxylate is calcium acetate.

6. The process of claim 3 where the calcium carboxylate is calcium acetate.

7. The product of claim 1.

8. The product of claim 2.

9. The product of claim 3.

10. The product of claim 4.

11. The product of claim 5.

12. The product of claim 6.

13. The process of claim 1 where the $CaCO_3$ formed has a particle size of no greater than about 5 microns.

14. The process of claim 1 where the $CaCO_3$ formed has a particle size of no greater than about 2 microns.

15. The process of claim 1 where the $CaCO_3$ has a particle size of no greater than 1 micron.

16. The process of claim 1 where the $CaCO_3$ product formed has an overbasing value of greater than about 1000%.

17. The process of claim 16 where the overbasing value of the $CaCO_3$ is 1060%.

* * * * *